US008733750B2

(12) United States Patent
Bernhardt

(10) Patent No.: US 8,733,750 B2
(45) Date of Patent: May 27, 2014

(54) 90° TABLE MOUNT

(75) Inventor: Randall J. Bernhardt, Dousman, WI (US)

(73) Assignee: Urban Manufacturing, Inc., Pewaukee, WI (US)

( * ) Notice: Subject to any disclaimer, the term of this patent is extended or adjusted under 35 U.S.C. 154(b) by 1160 days.

(21) Appl. No.: 12/231,788

(22) Filed: Sep. 5, 2008

(65) Prior Publication Data

US 2009/0160114 A1 Jun. 25, 2009

Related U.S. Application Data

(60) Provisional application No. 60/994,209, filed on Sep. 18, 2007.

(51) Int. Cl.
*B25B 1/00* (2006.01)

(52) U.S. Cl.
USPC ..... 269/61; 269/43

(58) Field of Classification Search
CPC ..... B25B 1/00; B25B 1/02; B25B 1/04; B25B 5/02; B25B 5/006; B25B 5/04
USPC ..... 269/99, 93–98, 261, 291, 309–310, 269/137, 71, 73
See application file for complete search history.

(56) References Cited

U.S. PATENT DOCUMENTS

| | | | | | |
|---|---|---|---|---|---|
| 4,413,818 | A * | 11/1983 | Lenz | 269/81 |
| 4,445,678 | A * | 5/1984 | George | 269/88 |
| 4,915,367 | A * | 4/1990 | Carossino | 269/101 |
| 5,234,205 | A * | 8/1993 | Shanley | 269/99 |
| 5,358,228 | A * | 10/1994 | Beere | 269/244 |
| 5,836,574 | A * | 11/1998 | Park | 269/93 |
| 6,113,088 | A * | 9/2000 | Gakhar et al. | 269/139 |
| 6,158,728 | A * | 12/2000 | Smith | 269/99 |
| 7,146,705 | B2 * | 12/2006 | Ahti et al. | 29/563 |
| 2009/0160114 | A1 * | 6/2009 | Bernhardt | 269/261 |

* cited by examiner

*Primary Examiner* — Lee D Wilson

(74) *Attorney, Agent, or Firm* — Ryan Kromholz & Manion, S.C.

(57) ABSTRACT

A mounting device for attaching a vise to a work surface so that the vise can be held in a position perpendicular to the work surface. The mounting device has a base having a surface for receiving the vise and an upright section that is perpendicular to the base. The mounting device further has a plurality of bolts or clamps that are used to removably secure the vise to the mounting device and also to secure the mounting device to the work surface.

20 Claims, 4 Drawing Sheets

90° TABLE MOUNT

RELATED APPLICATIONS

The present application claims priority to provisional patent application, U.S. Ser. No. 60/994,209 filed 18 Sep. 2007.

BACKGROUND OF THE INVENTION

The present invention relates to devices used in connection with jaw vises and jaw plates and, more specifically devices that will hold jaw vises and jaw plates in a secure position.

Vises are universally used to hold work pieces in place on table top or other flat surfaces. Generally, the vise sits parallel to the table top and is clamped to the table, thereby allowing the vise to hold in place and secure a work piece so that machining can be performed on the work piece.

Many advances related to vises and clamps and mounts for vises are related to working with irregular shaped work pieces. As such, such devices are designed to conform to the shape of the work piece, or employ some type of mechanism to change the angle from normal that the vise holds a work piece in place. However, most work pieces and parts are of a relatively normal geometric shape (i.e. cubes, cylinders, etc.) and machining of the part is done along either the horizontal or vertical axis of the work piece.

As an example, a cylinder may have machining done, either along the central axis of the cylinder or perpendicular to the central axis. While regular vises generally can be clamped to a table top either perpendicular to the table top or parallel to the table top to hold the cylinder, a vise usually will accommodate only one of these positions. That is, vises generally are designed to hold a work piece in either a horizontal or perpendicular position, but not both. It would be advantageous to have a clamp or mount that could easily secure a single vise in either a perpendicular or parallel position to the table top, in a quick, easy and efficient manner. Further, such a device must be solid so that the vise is properly and securely held in place when moved from the first position to the second position.

SUMMARY OF THE INVENTION

The present invention contemplates a clamping device that will be used in connection with vises and vise grips. The clamping device allows a vise that normally attaches parallel to a table top to be secured in a position perpendicular to the table top. That is, the clamping device will secure the vise to the table top in a position perpendicular to the normal position of the vise.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1:
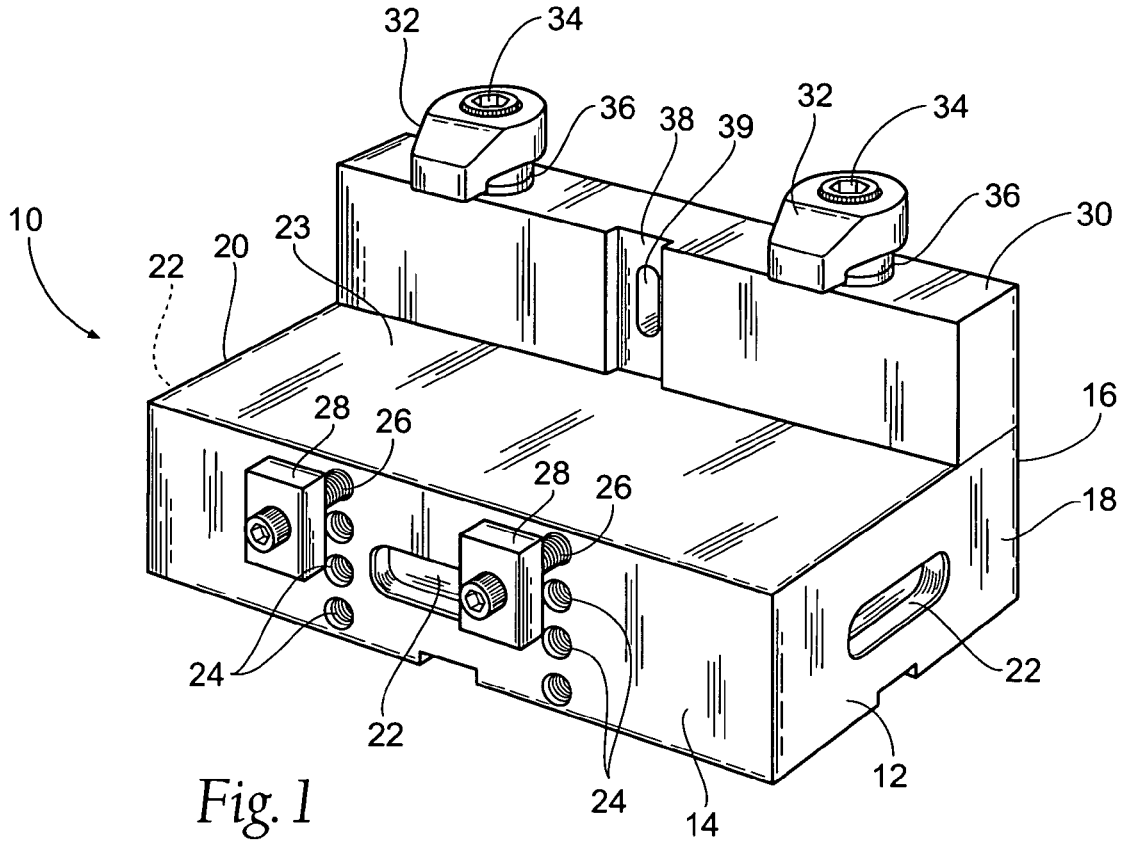
FIG. 1 is a front perspective view of a table top vise mount in accordance with the present invention.
Figure 2:
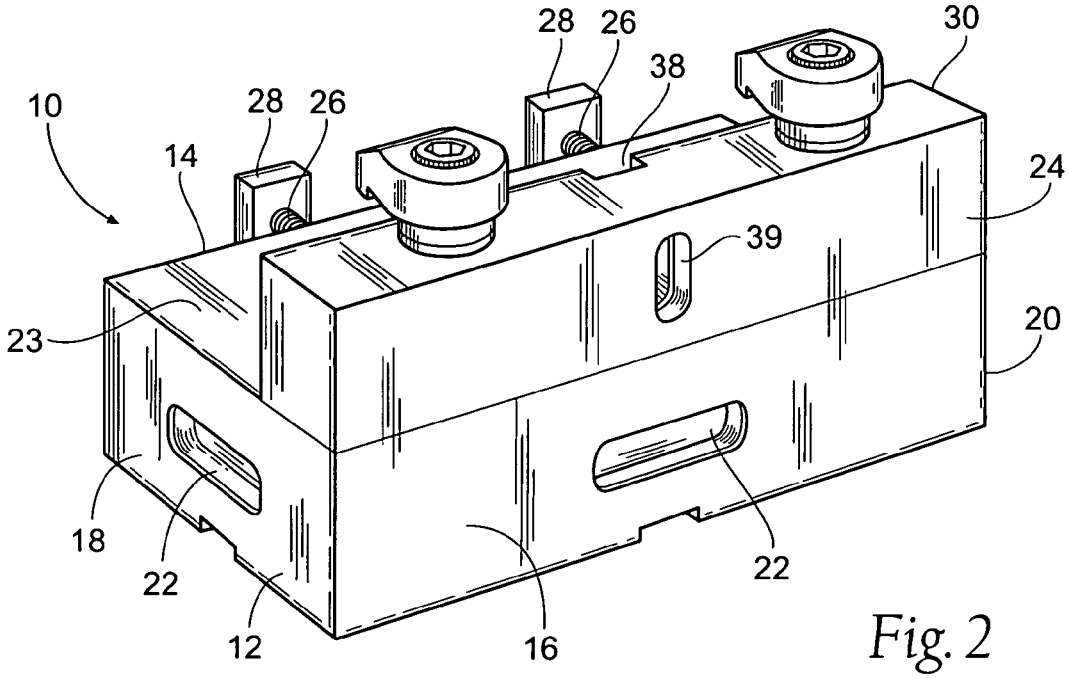
FIG. 2 is a rear perspective view of the vise mount of FIG. 1.

FIGS. 1 and 2 show perspective views of a mounting device 10 according to the present invention. The device 10 has a generally rectangular shaped base 12, having a front end 14, a rear end 16, and opposing side ends 18 and 20. Each of the ends 14, 16, 18, 20 has a slot 22 that allows the device 10 to be clamped to a work surface, preferably a table top 5 (see FIGS. 4-6). The base 12 has a flat surface 23 that allows a vise 40 (see FIGS. 4-6) to rest flush upon the surface 23. The base 12 has a plurality of threaded bores 24 on the front end 14 that allow for a plurality of threaded bolts 26 to be removably inserted into the bores 24. Each of the bolts 26 is shown supporting a stop block 28. The bolts 26 and the blocks 28 have a dual purpose. As shown, they can be used as means for extending the length of the surface 23, so that a work piece 50 (FIG. 6) may rest upon the blocks 28, if needed. The second use is shown further in FIG. 5. The bolt 26 and block 28 are used to secure the vise 40 to the device 10. It should be understood that the bores 24, the bolts 26, and the blocks 28 as shown are merely exemplary of securing and extending means for the device 10, and numerous other clamps, clips, clasps, extension sheets and the like could be used with the present invention and still fall within the scope of the present invention. It should also be understood that the securing means and the extension means could be designed as different styles of devices, as well.

Referring further to FIGS. 1 and 2, the device 10 comprises an upright section 30 that provides an abutment for the vise 40 to rest upon when connected to the device 10 so that the vise 40 can be held in a position perpendicular to the work surface 5. The upright section 30 is preferably flush with the back end 16 of the base section 12. The upright section 30 supports a pair of hooks 32 that will assist in securing the vice 40 to the device 10 (see FIG. 5). The hooks 32 are secured to the upright section 30 by way of a threaded bolt 34 that will intersect a threaded bore 36 so that the hooks 32 can be tightened and adjusted as needed. The hooks 32 are preferably biased against the upright section 30. It is understood that various securing means can be used with the present invention to secure the vise 40 in place, and the hooks 32 are merely exemplary and should not be considered as limiting on the scope of the invention.

The upright section 30 also has a cutaway area 38 having an opening 39 that passes through the upright section 30. The cutaway area 38 is shaped to receive one of the blocks 28, which will be used with one of the bolts 26 to secure the vise 30 to the device 10 (see FIG. 5). In an alternate embodiment, the cutaway area 38 may be partially filled in to remove the necessity of the block 28 being inserted into the cutaway area 38.

Figure 3:
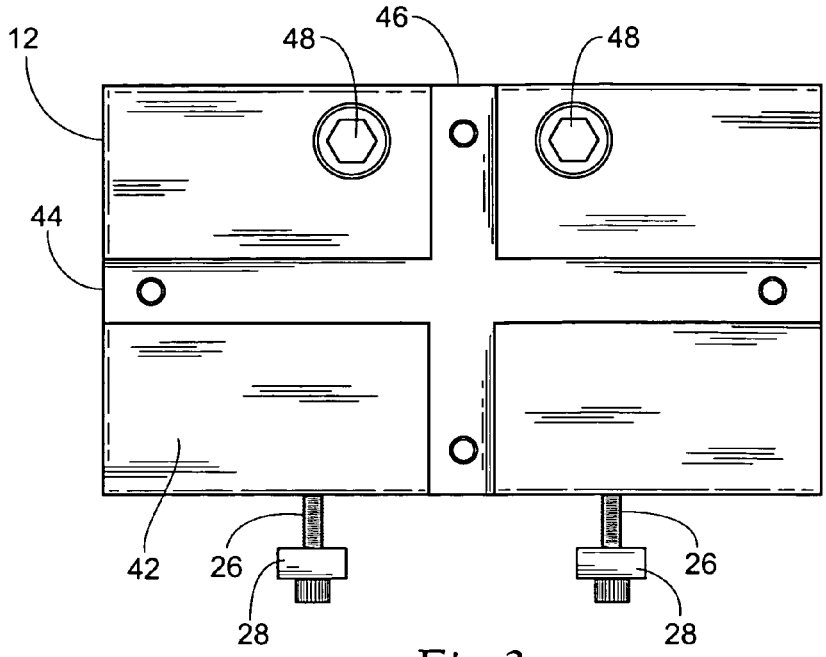
FIG. 3 is a bottom view of the vise mount of FIG. 1.

FIG. 3 shows a plan view of a bottom side 42 of the base section 12. The bottom side has a pair of tracks 44 and 46 that allows the base section 12 to be mated and secured with the table 5. Bolts 48 are preferably used to secure the base section 12 to the upright section 16, but other device can be used to join the two sections, or potentially the two sections could be designed as a single piece.

Figure 4:
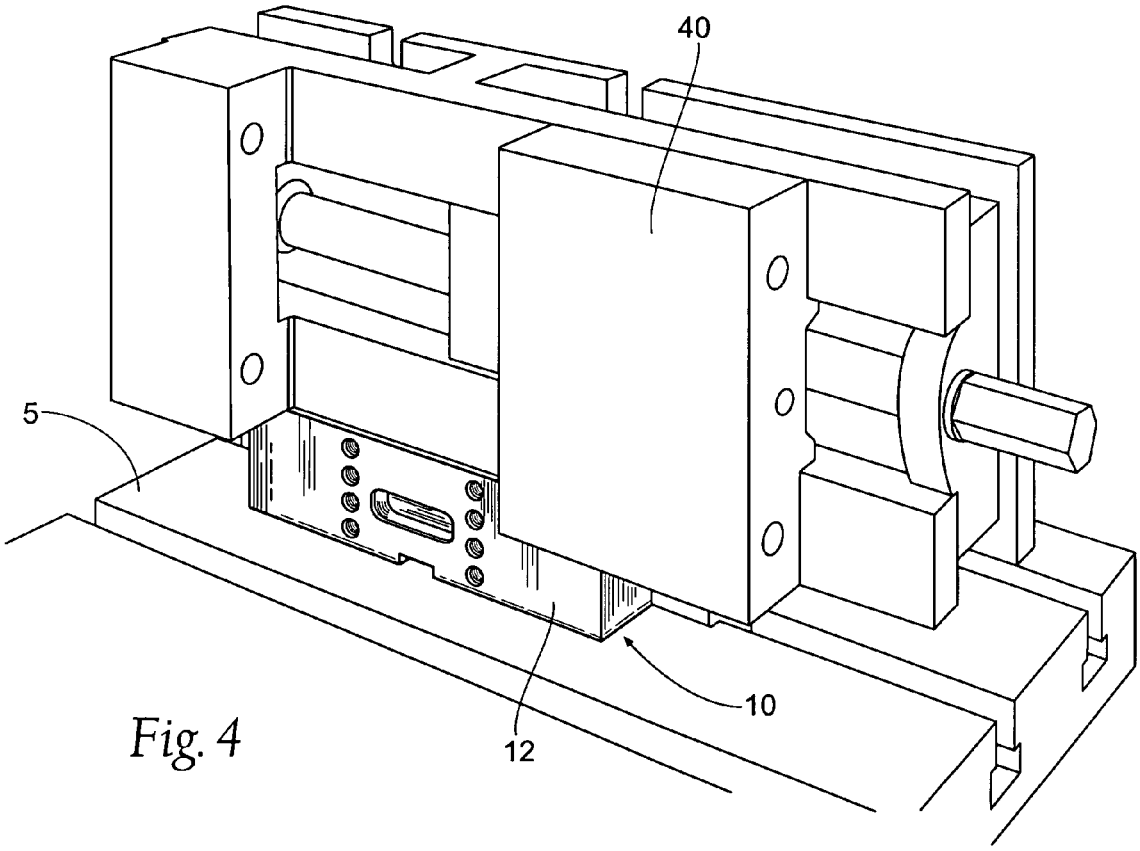
FIG. 4 is a front perspective view of the mount of FIG. 1 supporting a vise.
Figure 5:
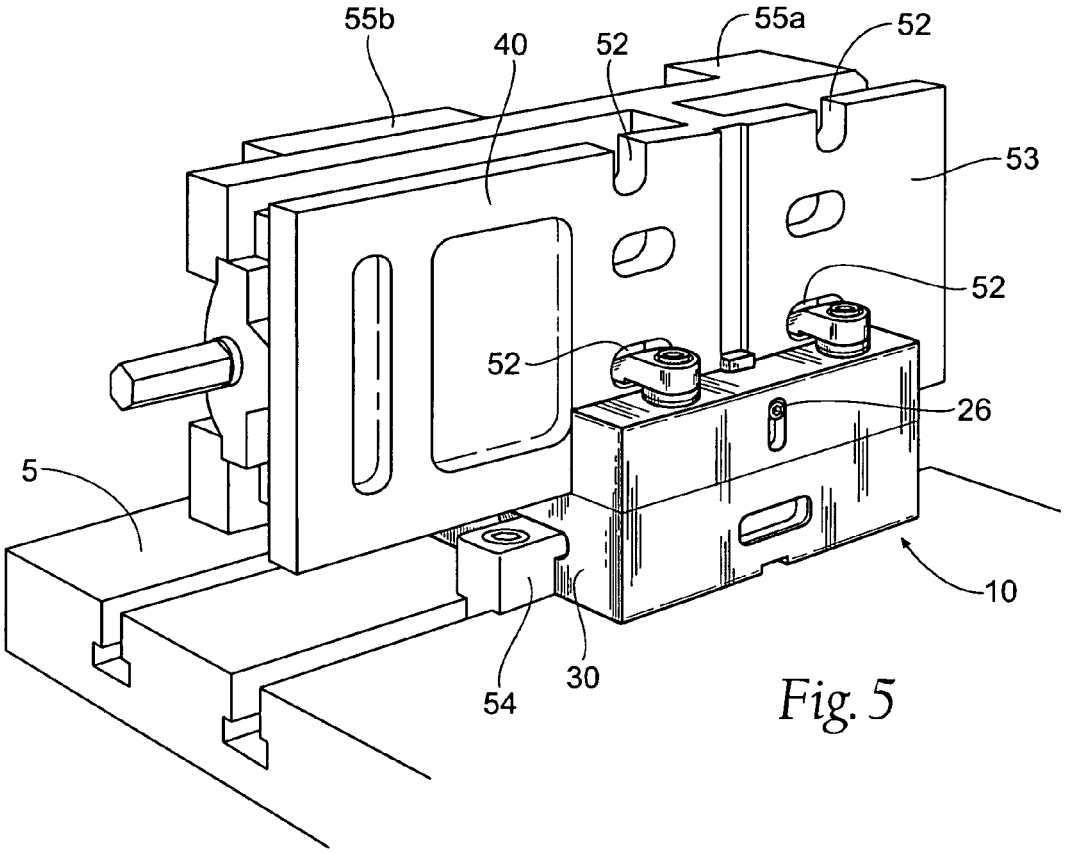
FIG. 5 is a rear perspective view of the mount of FIG. 4.

Referring now to FIGS. 4 and 5, the vise 40 is shown secured to the device 10 so that the vise 40 is perpendicular to the table surface 5. As shown in FIG. 5, the vise 40 has openings 52 on a bottom side 53 to receive the hooks 32 to firmly secure the vise 40 to the device 10. Once inserted, the hooks 32 can be tightened down to securely hold the vise 40 in place. The top or working side or area 55 has sections 55*a* and 55*b* that can be slid together to hold the work piece 50 in secure position so that it can be tooled and worked upon as necessary (see FIG. 6). The bolt 26 also assists in grabbing the vise 40. The device 10 itself is secured to the table 5 with the use of clamps 54 (FIGS. 5 and 6).

Figure 6:
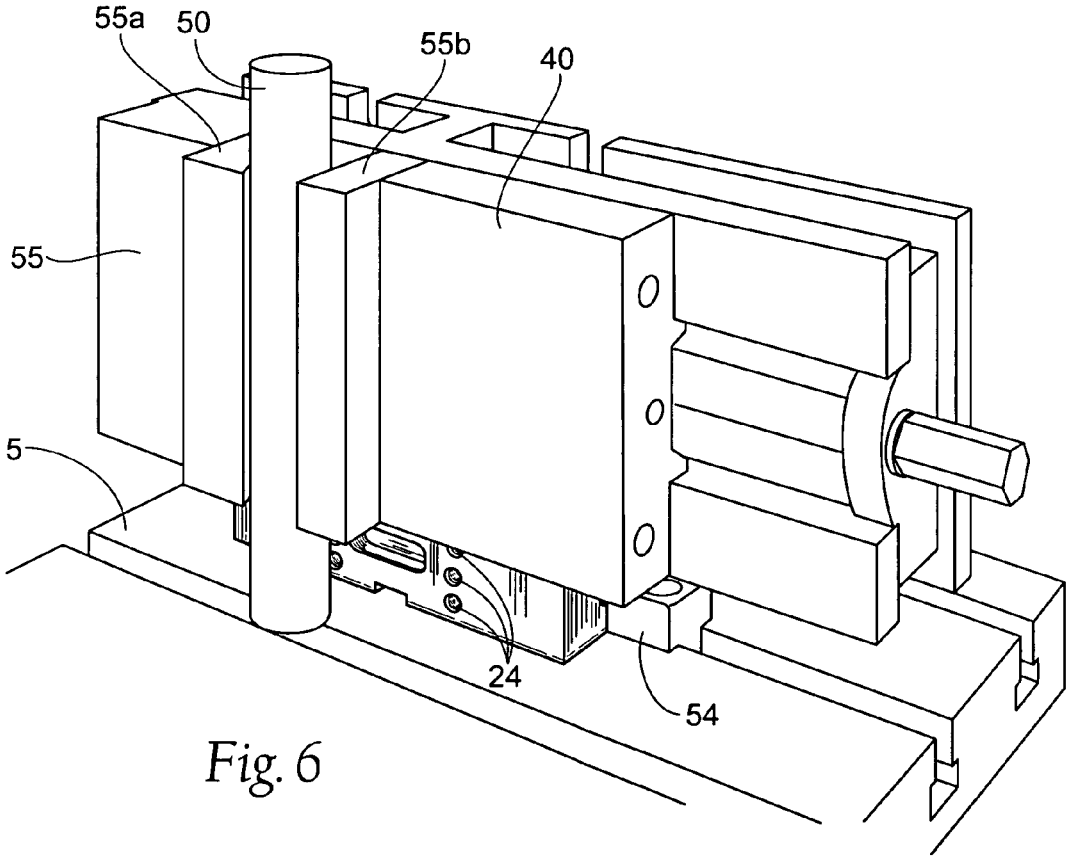
FIG. 6 is front perspective view of the mount of FIG. 4 retaining a work piece.

FIG. 6 shows the vise 40 supporting the work piece 50, with the sections 55*a* and 55*b* of the top or working side or area 55. Thus, the vise 40 will be held the work piece 50 in a fashion so that it is secure and can be held in place perpendicular to the normal working direction of the table or surface 5. As was noted above, the bores 24 could potentially support the bolts 26 or other extension means to provide an extended flat surface for the work piece 50 if necessary. Thus, the work piece 50 can be easily worked on along the elongated axis of the work piece 50 efficiently and securely. The vise 40 is easily and quickly held in place by the device 10. The base section 12 also lies above the table top 5 to give the user more play in positioning the work piece 50 and, also, gives some clearance room as a safety precaution.

Figure 7:
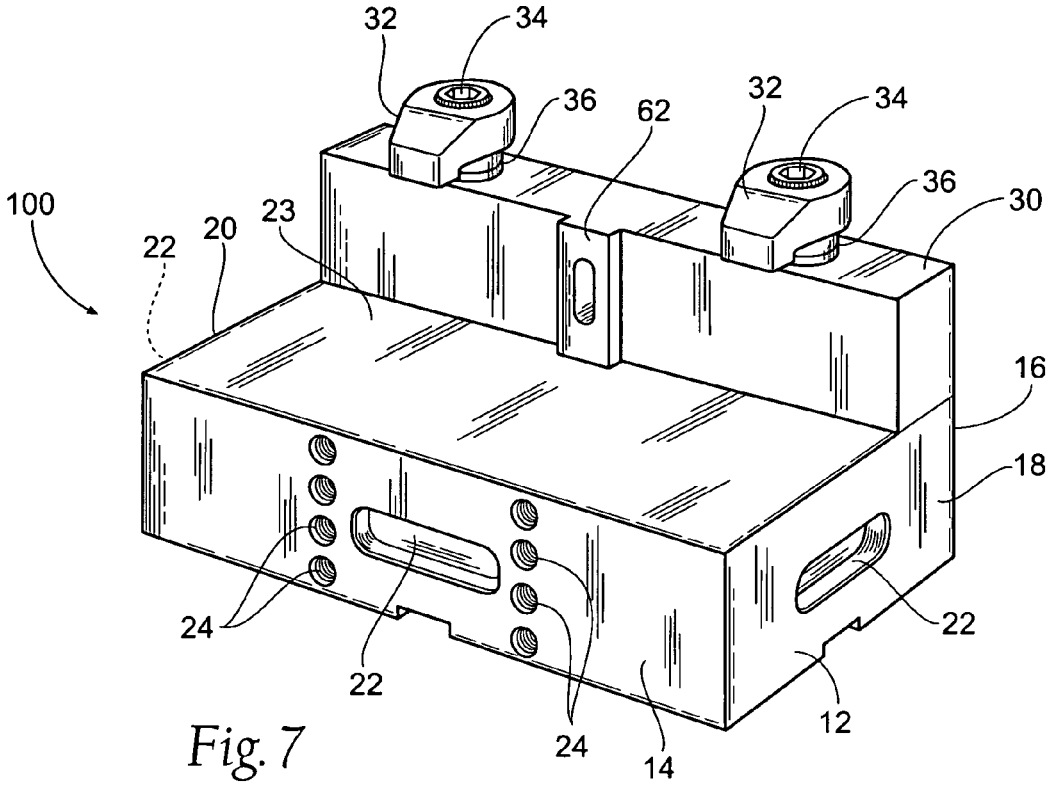
FIG. 7 is a perspective view of a second embodiment of the present invention.
Figure 8:
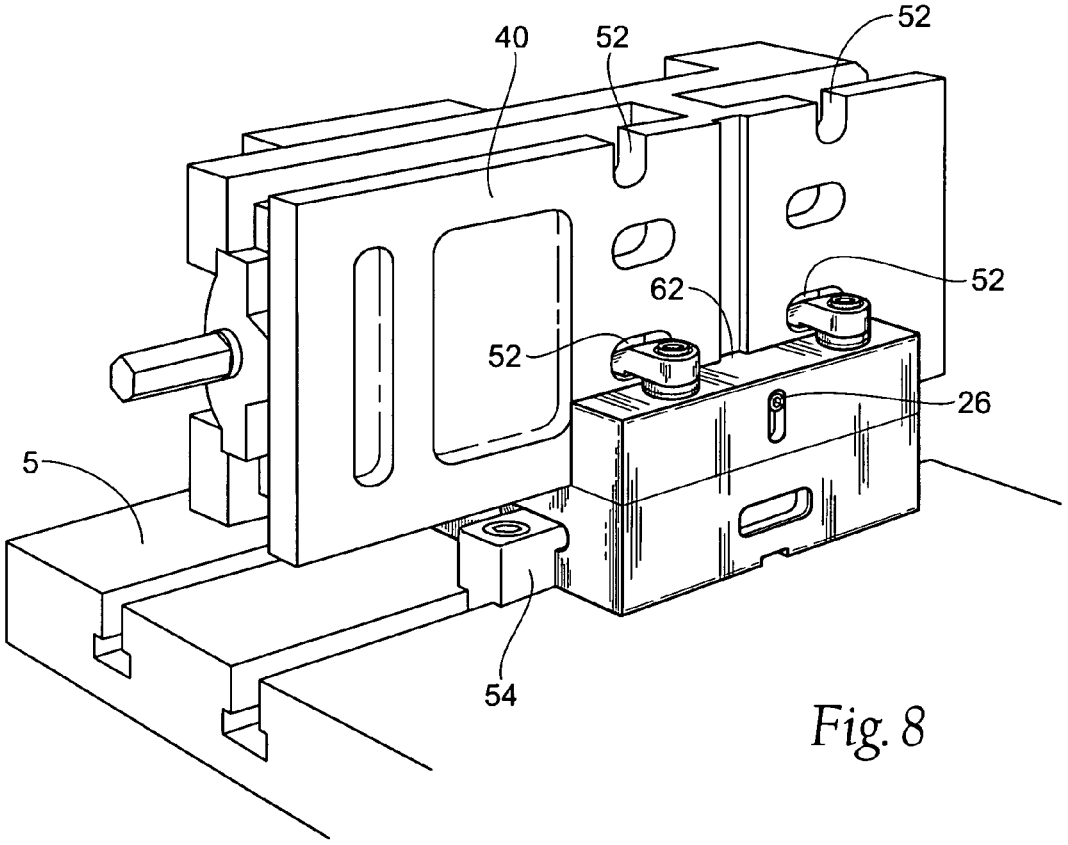
FIG. 8 is a rear perspective view of the embodiment of FIG. 7.

FIGS. 7 and 8 provide an alternate embodiment of the device 100. The device 100 is arranged essentially the same as the device 10 except for the arrangement of the upright section 30 and the means for securing the vise 40 to the upright section 30. As shown in FIG. 7, the cutaway area 38 that received one of the blocks 28 has been replaced by an external key block 62 that will mate with the vise 40. As FIG. 8 shows, a bolt 26 is still used to secure the key block 62 to the vise 40. Provided that an arrangement is provided to secure the vise 40 to the upright section 30, the arrangement would fall within the scope of the present invention.

It should also be noted that FIG. 7 is shown without bolts 26 and blocks 28 located on the front end 14. This has been done to show that any various types of stops may be used to position a work piece 50 and that the invention should not be limited to any specific stop, bolt, or extension piece. Furthermore, it is not necessary that any specific stop or extension is needed for the invention to be operable.

Thus the present invention provides a mounting device that is capable of changing the operating angle 90° with respect to a standard table top vise without needing to reconfigure the vise. That is, the present invention allows the operating axis of the vise to be rotated or turned a full right angle while still being capable of firmly gripping the work piece, so that it may be drilled, crimped, pressed, or whatever else may need to be done to the work piece without worrying that the work piece, or the axis of the work piece, will move while being machined.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

I claim:

1. A mounting device for attaching a vise to a work surface, wherein said vise has a bottom side and a working side, said mounting device comprising:
- a base having a surface for receiving said vise;
- said base further having an upright section projecting perpendicular from said base;
- means for removably securing said base to said work surface; and
- means for removably securing said vise to said upright section upon said base surface in a position wherein said bottom side of said vice is perpendicular to said work surface so that said work piece is securely held in place on said working side of said vice in a position perpendicular to said work surface when said vise is secured to said upright section.

2. The mounting device according to claim 1 further comprising means for extending said surface of said base.

3. The mounting device according to claim 2, wherein said extension means comprises at least one block attached to a bolt, said bolt being removably threaded into one of a plurality of threaded holes positioned longitudinally on said base.

4. The mounting device according to claim 3 further comprising a plurality of blocks attached to a plurality of bolts, said bolts comprising said extension means and said means for removably securing said vise to said upright section.

5. The mounting device according to claim 1 wherein said means for securing said base to said work surface comprises a plurality of clamps.

6. The mounting device according to claim 1 wherein said means for securing said vise to said uptight section comprises a bolt, said bolt being threaded into said upright section and said vise.

7. The mounting device according to claim 1, wherein said securing means for securing said use to said upright further comprises a pair of hooks located on said upright section, said hooks being arranged to grasp a surface of said vise.

8. A mounting device for attaching a vise to a work surface, wherein said vise has a bottom side and a working side, said mounting device comprising:
- a base having a surface for receiving said vise;
- said base further having an upright section projecting perpendicular from said base;
- means for removably securing said base to said work surface;
- a plurality of slots located in said base for receiving said means for removably securing said base to said work surface; and
- means for removably securing said vise to said upright section upon said base surface in a position wherein said bottom side of said vice is perpendicular to said work surface so that said work piece is securely held in place on said working side of said vice in a position perpendicular to said work surface when said vise is secured to said upright section.

9. The mounting device according to claim 8 further comprising means for extending said surface of said base.

10. The mounting device according to claim 9, wherein said extension means comprises at least one block attached to a bolt, said bolt being threaded into one of a plurality of threaded holes positioned in substantially longitudinal alignment on said base.

11. The mounting device according to claim 8 wherein said means for securing said base to said work surface comprises a plurality of clamps.

12. The mounting device according to claim 8 wherein said means for securing said vise to said upright section comprises a bolt, said bolt being threaded into said upright section and said vise.

13. The mounting device according to claim 8, wherein said securing means for securing said vise to said upright further comprises a pair of hooks located on said upright section, said hooks being arranged to grasp a surface of said vise.

14. A mounting device for attaching a vise to a work surface, wherein said vise has a bottom side and a working side, said mounting device comprising:

a base having a surface for receiving said vise;

said base further having an upright section projecting perpendicular from said base;

means for removably securing said base to said work surface;

a plurality of slots located in said base for receiving said means for removably securing said base to said work surface;

means for removably securing said vise to said upright section upon said base surface in a position wherein said bottom side of said vice is perpendicular to said work surface so that said work piece is securely held in place on said working side of said vice in a position perpendicular to said work surface when said vise is secured to said upright section; and a key block located on said upright section, said key block arranged to mate with said vise when said vise is in said perpendicular position.

15. The mounting device according to claim 14 further comprising means for extending said surface of said base.

16. The mounting device according to claim 15, wherein said extension means comprises at least one block attached to a bolt, said bolt being threaded into one of a plurality of threaded holes positioned longitudinally on said base.

17. The mounting device according to claim 14 wherein said means for securing said base to said work surface comprises a plurality of clamps.

18. The mounting device according to claim 14 wherein said means for securing said vise to said upright section comprises a bolt, said bolt being threaded into said upright section and said vise.

19. The mounting device according to claim 14, wherein said securing means for securing said vise to said upright further comprises a pair of hooks located on said upright section, said hooks being arranged to grasp a surface of said vise.

20. The mounting device of claim 1 wherein said upright section has an aperture formed therethrough for receiving said means for removably securing said vise to said upright section.

* * * * *

UNITED STATES PATENT AND TRADEMARK OFFICE

CERTIFICATE OF CORRECTION

PATENT NO. : 8,733,750 B2
APPLICATION NO. : 12/231788
DATED : May 27, 2014
INVENTOR(S) : Randy J. Bernhardt It is certified that error appears in the above-identified patent and that said Letters Patent is hereby corrected as shown below:

In the Claims

Column 4, line 12 of claim 1, after "bottom side of said" delete "vice" and substitute -- vise --

Column 4, line 14 of claim 1, after "working side of said" delete "vice" and substitute -- vise --

Column 4, line 32 of claim 6, delete "uptight" and substitute -- upright --

Column 4, line 36 of claim 7, after "securing said" delete "use" and substitute -- vise --

Column 4, line 36 of claim 7, after "upright" insert -- section --

Column 4, line 53 of claim 8, after "bottom side of said" delete "vice" and substitute -- vise --

Column 4, line 55 of claim 8, after "working side of said" delete "vice" and substitute -- vise --

Column 5, line 6 of claim 13, after "said vise to said upright" insert -- section --

Column 5, line 23 of claim 14, after "bottom side of said" delete "vice" and substitute -- vise --

Column 5, line 25 of claim 14, after "working side of said" delete "vice" and substitute -- vise --

Column 6, line 18 of claim 19, after "said vise to said upright" insert -- section --

Signed and Sealed this
Seventeenth Day of March, 2015

Michelle K. Lee

Michelle K. Lee
*Director of the United States Patent and Trademark Office*